United States Patent [19]

Duerig et al.

[11] Patent Number: 4,502,896

[45] Date of Patent: Mar. 5, 1985

[54] METHOD OF PROCESSING BETA-PHASE NICKEL/TITANIUM-BASE ALLOYS AND ARTICLES PRODUCED THEREFROM

[75] Inventors: Tom Duerig, Fremont; Keith Melton, Cupertino, both of Calif.

[73] Assignee: Raychem Corporation, Menlo Park, Calif.

[21] Appl. No.: 596,771

[22] Filed: Apr. 4, 1984

[51] Int. Cl.[3] ..... C22F 1/10

[52] U.S. Cl. ..... 148/11.5 F; 148/11.5 N; 148/402

[58] Field of Search ..... 148/11.5 F, 11.5 N, 148/402

[56] References Cited

U.S. PATENT DOCUMENTS

| | | | |
|---|---|---|---|
| 3,753,700 | 8/1973 | Harrison et al. | 148/402 |
| 3,948,688 | 4/1976 | Clark | 148/402 |
| 3,953,253 | 4/1976 | Clark | 148/402 |
| 4,001,928 | 1/1977 | Schweiso | 148/11.5 F |

*Primary Examiner*—W. Stallard

*Attorney, Agent, or Firm*—Ira D. Blecker

[57] ABSTRACT

Disclosed is a method for processing beta-phase nickel/titanium-base alloys. According to the method, the alloys are warm worked and then warm annealed. The working and annealing temperatures are in the range of about 350° to 600° C. Also disclosed is an article produced by the method.

22 Claims, 1 Drawing Figure

METHOD OF PROCESSING BETA-PHASE NICKEL/TITANIUM-BASE ALLOYS AND ARTICLES PRODUCED THEREFROM

BACKGROUND OF THE INVENTION

This invention relates to the field of processing beta-phase nickel/titanium-base alloys and, more particularly, to the field of processing beta-phase nickel/titanium-base, shape-memory alloys.

Materials, both organic and metallic, capable of possessing shape memory are well known. An article made of such materials can be deformed from an original, heat-stable configuration to a second, heat-unstable configuration. The article is said to have shape memory for the reason that, upon the application of the heat alone, it can be caused to revert or attempt to revert from its heat-unstable configuration to its original, heat-stable configuration, i.e., it "remembers" its original shape.

Among metallic alloys the ability to possess shape memory is a result of the fact that the alloy undergoes a reversible transformation from an austenitic state to a martensitic state with a change of temperature. Also, the alloy is considerably stronger in its austenitic state than in its martensitic state. This transformation is sometimes referred to as a thermoelastic martensitic transformation. An article made from such an alloy, for example, a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete), the deformed object will begin to return to its original configuration.

Alloys of nickel and titanium have been demonstrated to have shape-memory properties which render them highly useful in a variety of applications.

Shape-memory alloys have found use in recent years in, for example, pipe couplings (such as are described in U.S. Pat. Nos. 4,035,007 and 4,198,081 to Harrison and Jervis), electrical connectors (such as are described in U.S. Pat. No. 3,740,839 to Otte and Fischer), switches (such as are described in U.S. Pat. No. 4,205,293), actuators, etc., the disclosures of which are incorporated hereby by reference.

Notwithstanding the obvious utility of shape-memory alloys, the forming of parts from shape-memory alloys present certain difficulties. Some of the shape-memory alloys, such as those illustrated in U.S. Pat. No. 4,283,233 to Goldstein et al. may be readily cold worked followed by a warm anneal. Other alloys, such as those found in U.S. Pat. No. 3,753,700 to Harrison et al., are subject to serve embrittlement when cold worked. These latter alloys are usually hot worked followed by hot anneal. An alternative treatment of these latter alloys would be working at liquid-nitrogen temperatures to take advantage of the increased ductility of the martensitic phase. Needless to say, such a treatment is impractical.

In the typical prior uses of shape-memory alloys, the deformed object is allowed to begin reversion to its original configuration without being restrained by a force of any great amount. For example, in the pipe couplings of the aforementioned U.S. Pat. Nos. 4,035,007 and 4,198,001, the coupling when heated is allowed to freely contract until constrained by the external dimensions of the pipe.

It has been found, however, that the amount of motion of the heated, recoverable member is drastically reduced when a restraining load is applied. With increasing load, the amount of motion at recovery is correspondingly reduced. At some amount of applied load, the amount of motion will be effectively zero. In other words, the amount of work that is obtainable from any recoverable member is reduced as the restraining load is increased.

It would be desirable to increase the work obtainable from any recoverable member.

Thus it is an object of the invention to increase the amount of work that can be obtained from a heat-recoverable, shape-memory alloy member when it is subject to restraint by an applied force.

It is another object of the invention to increase the amount of force that can be obtained from a rigidly restrained, heat-recoverable member by a method that is practically feasible.

It is still another object of the invention to process an alloy having limited cold ductility by a method that is practically feasible.

It is a further object of the invention to manufacture an article by this method.

These and other objects of the invention will become apparent to those skilled in the art after considering the following description in conjunction with the accompanying drawings.

BRIEF SUMMARY OF THE INVENTION

Disclosed according to the invention, is a method for processing a beta-phase nickel/titanium-base alloy. The method comprises warm working the alloy and then warm annealing the alloy. The working and annealing temperatures are in the range of about 350° to 600° C. There is also disclosed, according to the invention, an article made by this method.

BRIEF DESCRIPTION OF THE DRAWING

The FIGURE is a graph of the recovery of a shape-memory alloy according to the method of this invention compared to the recovery of the same alloy according to the prior art.

DETAILED DESCRIPTION OF THE INVENTION

Figure 1:
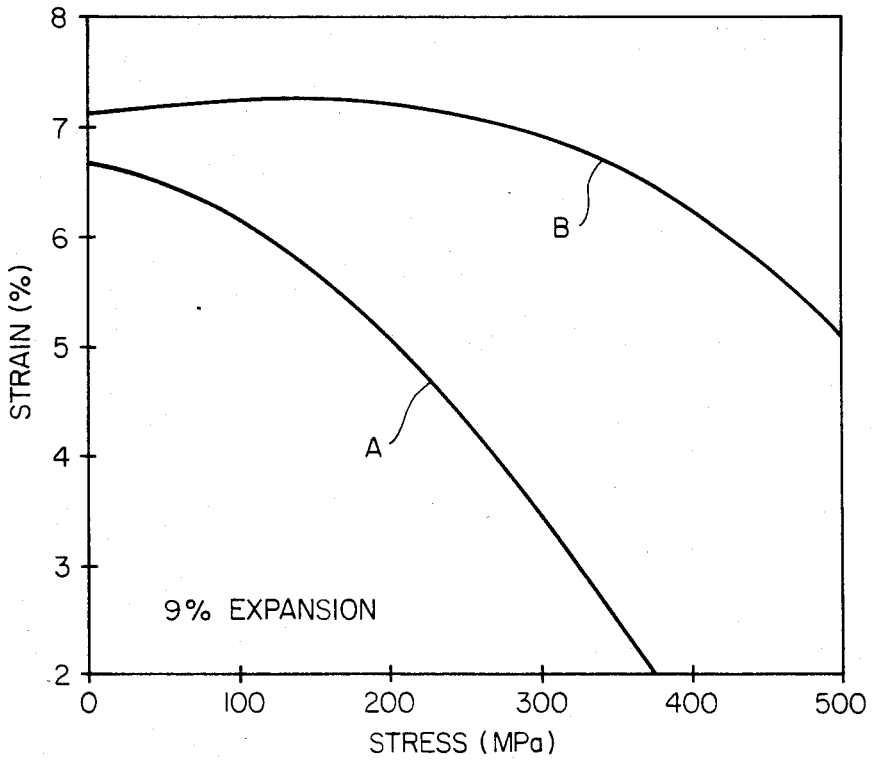

Disclosed according to the invention is a method for processing an essentially beta-phase nickel/titanium-base alloy. The method comprises warm working the alloy and then annealing the alloy. The working and annealing temperatures are in the range of about 350° to 600° C. In order to effectuate the objects of the invention, it is necessary that the working and annealing temperatures, while in the range of about 350° to 600° C., should, in any event, be below the recrystallization temperature of the alloy.

The prior art problem of limited cold ductility is overcome by controlling the working temperature which should be sufficiently high enough above room temperature such that the material has improved workability (i.e., sufficient ductility) and enough dynamic recovery occurs to prevent excessive work hardening on successive passes but not so high that the dislocations generated by the working are anihilated by a thermally activated climb/glide process. Specifically, the working temperature is above that at which recovery takes place but below that at which full recrystallization occurs.

When the material is worked according to the invention, a cell structure is produced in which the cell walls are very sharp and well defined. The fine subgrains thus produced provide material with substantially higher austenitic yield strengths than conventionally hot-worked material, i.e., material where the working and annealing temperatures are above those at which recrystallization occurs.

In order to complete the subgrain or cell formation, the warm-worked material is annealed at a temperature similar to the working temperature. When the material is warm worked in the upper part of the 350° to 600° C. temperature range, the material may be annealed at the same time due to the warm working so that a separate annealing step is not necessary and, in fact, is optional.

While the perferred working and annealing temperatures of the alloy are in the range of about 350° to 600° C., it is most preferred that the working and annealing temperatures be about 500° C. It is also preferable that the alloy be annealed for about one hour.

The method of the invention may also include air-cooling the alloy to room temperature after the warm-working step. This may be necessary when the alloy is transferred from the place of warm working to the annealing oven.

While not necessary, it is preferable that after the step of annealing the method of the invention further comprise a step of air-cooling to room temperature.

It is contemplated that there are many forms of warm working of the alloy which will produce the desired objects of the invention. Preferred forms of warm working are drawing, swaging, or warm rolling. However, other similar types of warm working are also contemplated within the scope of the invention.

The method according to the invention, while applicable to many different types of beta-phase nickel/-titanium-base alloys and shape-memory alloys, has particular application to shape-memory alloys and most particular application to those types of shape-memory alloys which have limited cold ductility. One alloy system having such limited cold ductility is the ternary shape-memory alloy comprised of nickel, titanium, and iron, as illustrated in U.S. Pat. No. 3,753,700 to Harrison et al., previously referred to in the Background of the Invention. When practicing the method of this invention with the ternary shape-memory alloy of Harrison et al., it is preferred that the warm working and annealing of the alloy occur below the recrystallization temperature of the Harrison et al. alloy, which is about 550° to 600° C.

The advantages of the invention will become more apparent after reference to the following examples.

EXAMPLE 1

Two sets of articles were prepared from a ternary alloy of nickel, titanium, and iron. The alloy had a nominal composition of $Ti_{50}Ni_{47}Fe_3$ in atomic percent. One set of articles was hot worked and annealed at 850° C. Another set of articles was warm worked and annealed at 500° C. Each set of specimens was strained at −196° C. to total strains between 7 and 10%. The loading rate was 50 Newtons per second. After reaching the desired loads, the loads were ramped back to zero and the permanent strains were recorded. The specimens were then loaded to various loads and heated so as to effect recovery. During heating, the recovery was recorded.

The results were graphed on FIG. 1. Curve A represents those samples which were prepared according to the prior art. These samples were the ones that were hot worked and hot annealed at 850° C. Curve 8 represents articles prepared according to the method of this invention. These articles were warm worked and warm annealed at 500° C.

The difference between the two sets of articles is surprising and totally unexpected. It is evident that for any amount of load applied to the articles, the articles which were warm worked and warm annealed had a greater amount of recovery than those that were hot worked and hot annealed. Thus, the amount of work obtainable with the instant invention is significantly greater than that available in the prior art. It is also evident that the amount of motion, or the amount of work that can be obtained decreases less fast with increasing load with the articles prepared according to the method of this invention than with the articles prepared according to the prior art method.

It will be obvious to those skilled in the art, having regard to this disclosure, that modifications of this invention, beyond those embodiments specifically described here, may be made without departing from the spirit of this invention. Accordingly, such modifications are considered to be within the scope of this invention as limited solely by the accompanying claims.

We claim:

1. A method for processing a beta-phase nickel/titanium-base alloy comprising: warm working the alloy; wherein the working temperature is in a range such that the lower limit is where the material has sufficient ductility and enough dynamic recovery occurs to prevent excessive work hardening on successive passes and the upper limit is the temperature above which recrystallization occurs.

2. The method of claim 1 further comprising the step of annealing the alloy wherein the annealing temperature is in the same range as the working temperature.

3. The method of claim 2, wherein said working and annealing temperatures are in the range of about 350° to 600° C.

4. A method for heat-treating a beta-phase nickel/-titanium-base alloy comprising warm working the alloy; annealing the alloy; wherein the working and annealing temperatures are below the recrystallization temperature of the alloy.

5. The method of claims 3 or 4 further comprising the step of air-cooling to room temperature after the step of annealing.

6. The method of claims 3 or 4 further comprising the step of air-cooling between the steps of warm working and annealing.

7. The method of claims 1 or 4 wherein said warm working is by drawing, swaging, or warm rolling.

8. The method of claim 3 wherein said working and annealing temperatures are about 500° C.

9. The method of claims 2 or 4 wherein said alloy is annealed for about one hour.

10. The method of claims 1 or 4 wherein said alloy is a ternary shape-memory alloy having a composition of nickel, titanium, and iron.

11. The method of claims 1 or 4 wherein said recrystallization temperature is in the range of about 550° to 600° C.

12. A beta-phase nickel/titanium-base alloy article prepared by the process of warm working the alloy; wherein the working temperature is in a range such that the lower limit is where the material has sufficient ductility and enough dynamic recovery occurs to prevent excessive work hardening on successive passes and the upper limit is the temperature above which recrystallization occurs.

13. The article prepared by the process of claim 12 further comprising the step of annealing the alloy wherein the annealing temperature is in the same range as the working temperature.

14. The article prepared by the process of claim 13 wherein said working and annealing temperatures are in the range of about 350° to 600° C.

15. A beta-phase nickel/titanium-base alloy article prepared by the process of warm working the alloy; annealing the alloy; wherein the working and annealing temperatures are below the recystallization temperatures of the alloy.

16. The article prepared by the process of claims 14 or 15 further comprising the step of air-cooling to room temperature after the step of annealing.

17. The article prepared by the process of claims 14 or 15 further comprising the step of air-cooling between the steps of warm working and annealing.

18. The article prepared by the process of claims 12 or 15 wherein said warm working is by drawing, swaging, or warm rolling.

19. The article prepared by the process of claim 14 wherein said working and annealing temperatures are about 500° C.

20. The article prepared by the process of claims 13 or 15 wherein said alloy is annealed for about one hour.

21. The article prepared by the process of claims 12 or 15 wherein said alloy is a ternary shape-memory alloy having a composition of nickel, titanium, and iron.

22. The article prepared by the process of claims 12 or 15 wherein said recrystallization temperature is in the range of about 550° to 600° C.

* * * * *

UNITED STATES PATENT AND TRADEMARK OFFICE

CERTIFICATE OF CORRECTION

PATENT NO. : 4,502,896

DATED : March 5, 1985

INVENTOR(S) : Tom Duerig/Keith Melton

It is certified that error appears in the above-identified patent and that said Letters Patent are hereby corrected as shown below:

Col. 1, line 58, mispelled "serve" should read "severe"

Col. 4, line 6, mispelled "8" should read "B"

Signed and Sealed this

*Third* Day of *June 1986*

[SEAL]

*Attest:*

DONALD J. QUIGG

*Attesting Officer*

*Commissioner of Patents and Trademarks*